US007980012B2

(12) United States Patent
Peterson et al.

(10) Patent No.: US 7,980,012 B2
(45) Date of Patent: Jul. 19, 2011

(54) POCKET INSERT BADGE WITH MAGNETIC RETENTION

(75) Inventors: James P. Peterson, Manitowoc, WI (US); Arnold M. Kapitz, Manitowoc, WI (US)

(73) Assignee: Contemporary, Inc., Manitowoc, WI (US)

( * ) Notice: Subject to any disclaimer, the term of this patent is extended or adjusted under 35 U.S.C. 154(b) by 0 days.

(21) Appl. No.: 12/835,651

(22) Filed: Jul. 13, 2010

(65) Prior Publication Data

US 2011/0047838 A1 Mar. 3, 2011

Related U.S. Application Data

(60) Provisional application No. 61/225,116, filed on Jul. 13, 2009.

(51) Int. Cl.
*A44C 3/00* (2006.01)

(52) U.S. Cl. ..... 40/1.5; 224/183

(58) Field of Classification Search ..... 40/1.6, 40/661.01; 224/183

See application file for complete search history.

(56) References Cited

U.S. PATENT DOCUMENTS

| | | | | |
|---|---|---|---|---|
| 2,592,395 | A * | 4/1952 | Cummings | 24/66.1 |
| 3,295,235 | A * | 1/1967 | Tauber | 40/1.5 |
| 3,931,688 | A * | 1/1976 | Owens | 40/1.5 |
| 6,684,544 | B1 * | 2/2004 | Buettell | 40/661.01 |
| 7,854,021 | B2 * | 12/2010 | Compton et al. | 2/249 |

* cited by examiner

*Primary Examiner* — Joanne Silbermann
*Assistant Examiner* — Kristina Staley
(74) *Attorney, Agent, or Firm* — Michael Best & Friedrich LLP

(57) ABSTRACT

An identification badge for placement within a pocket of a garment. The identification badge includes a first portion shaped to be received within the pocket, the first portion having a coupling member in the form of a magnet. The identification badge also includes a second portion coupled to the first portion by a flexible member, the second member having indicia printed thereon. The second portion is moveable with respect to the first portion between an open position and a closed position and in some embodiments is ferromagnetic such that the magnetic coupling member secures the second portion in the closed position.

1 Claim, 7 Drawing Sheets

POCKET INSERT BADGE WITH MAGNETIC RETENTION

CROSS-REFERENCE TO RELATED APPLICATION

This application claims the benefit of and priority to U.S. Provisional Patent Application No. 61/225,116 filed Jul. 13, 2009, the entire contents of which are hereby incorporated by reference.

BACKGROUND OF THE INVENTION

The present invention relates to an identification badge and more specifically to an identification badge that can be worn in a user's pocket.

During most business events, such as conferences, conventions, meetings and the like, many attendees prefer to wear a name tag or other form of identification device that clearly displays their name, title, place of employment, or other important information. Typically, these tags require the use of pins, adhesives, or the like that, once removed, can leave the user's garment full of pin holes, sticky residue, or otherwise damage the fabric. This is especially true in the case of pin style tags where an inadvertent pull or tug on the tag can often times cause the fabric of the user's clothes to rip or tear. Furthermore, adhesive style identification tags can only be used once and can wear over time, often times to the point where the adhesive is no longer usable and the badge falls off the user prematurely.

SUMMARY OF THE INVENTION

Some embodiments of the present invention may provide a badge for placement within a pocket of a garment, the badge including a first portion shaped to be received within the pocket and including a coupling member. The badge also includes a second portion coupled to the first portion by a flexible member having indicia printed thereon. The second portion is moveable with respect to the first portion between an open position and a closed position, where the coupling member secures the second portion in the closed position.

Other embodiments of the present invention may provide a badge for placement within a pocket, the badge including a first portion shaped to be received within the pocket, the first portion having a base plate, a cover plate coupled to the base plate, and a magnet coupled to the base plate and at least partially surrounded by the cover plate. At least one of the base plate and the cover plate includes at least one alignment pin and the other of the base plate and the cover plate includes at least one alignment opening, the at least one alignment pin received by and secured within the at least one alignment opening. The badge also includes a flexible member coupled to the first portion, the flexible member including a first end defining an aperture through which the at least one alignment pin extends, the flexible member including a second end extending away from the first portion. The badge also includes a ferro-magnetic second portion coupled to the second end of the flexible member and movable relative to the first portion, the second portion including a first plate with indicia thereon and a second plate. The second end of the flexible member is positioned between the first plate and the second plate. The second portion moveable between an open position and a closed position. Where attraction between the ferro-magnetic second portion and the magnet secures the second portion in the closed position.

DETAILED DESCRIPTION

Figure 1:
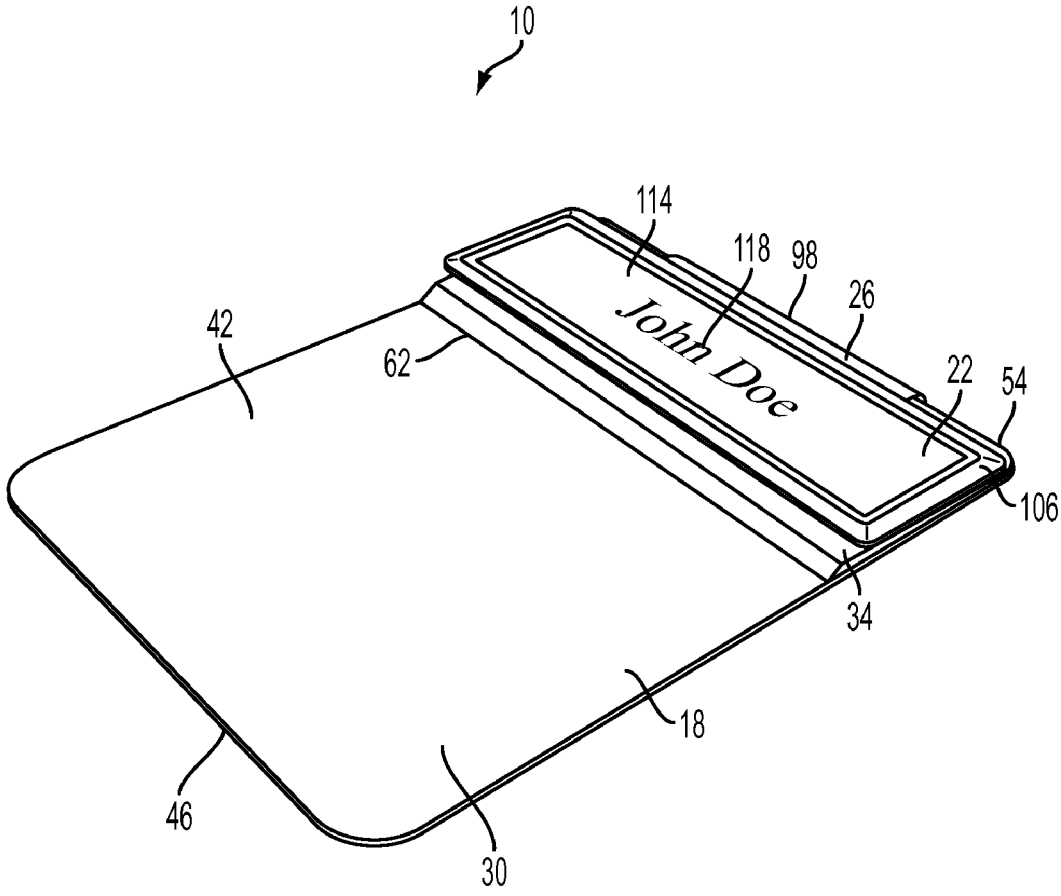
FIG. 1 is a perspective view of an identification badge in a closed position.

It is to be understood that the invention is not limited in its application to the details of construction and the arrangements of the components set forth in the following description or embodiments, or illustrated in the drawings. The invention is capable of other embodiments and of being practiced or being carried out in various ways. Also, it is to be understood that the phraseology and terminology used herein is for the purpose of description and should not be regarded as limiting.

Figure 2:
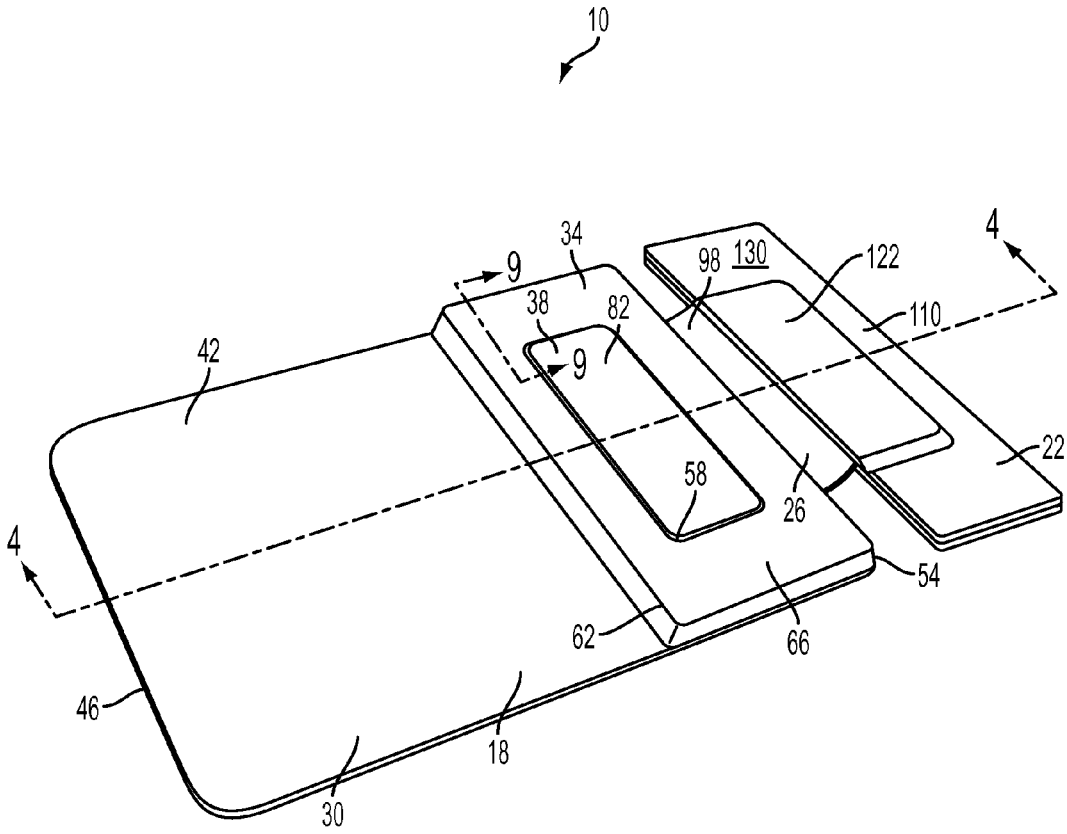
FIG. 2 is a perspective view of the identification badge of FIG. 1 in an open position.
Figure 3:
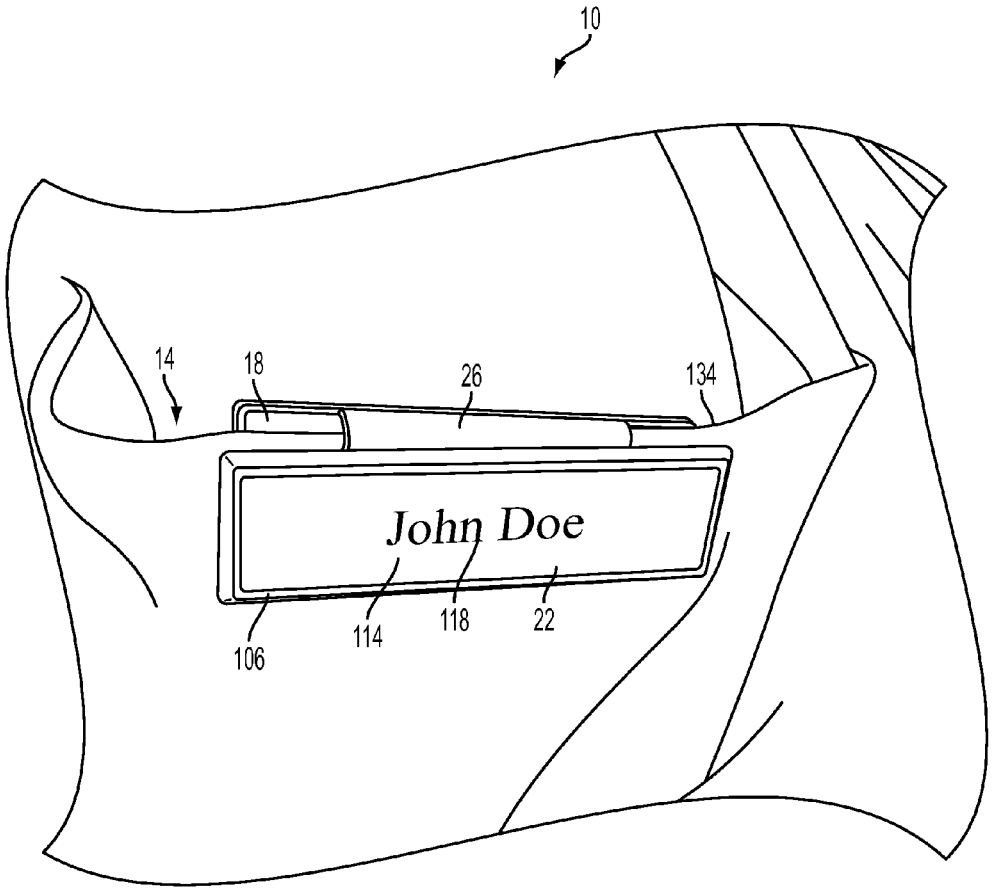
FIG. 3 illustrates the identification badge of FIG. 1 positioned within a pocket.

FIGS. 1-3 illustrate an identification badge 10 couplable to a user's clothing and configured to display the user's name, title, company of employment, or other information in a highly visible and easily readable manner. The badge 10 is constructed to be at least partially received within and removably secured to a pocket 14 of the user's clothing (e.g., the front pocket of a button up shirt or jacket; see FIG. 3) such that the badge 10 will remain in place throughout the course of the day without damaging the garment by leaving pin holes, adhesive residue, and the like. In the illustrated construction, the badge 10 includes a first portion 18 positionable within the pocket 14 and a second portion 22 moveably coupled to the first portion 18 via a flexible hinge member 26. The second portion 22 has indicia printed thereon that is forwardly displayed when the badge 10 is secured in the pocket 14.

Figure 4:
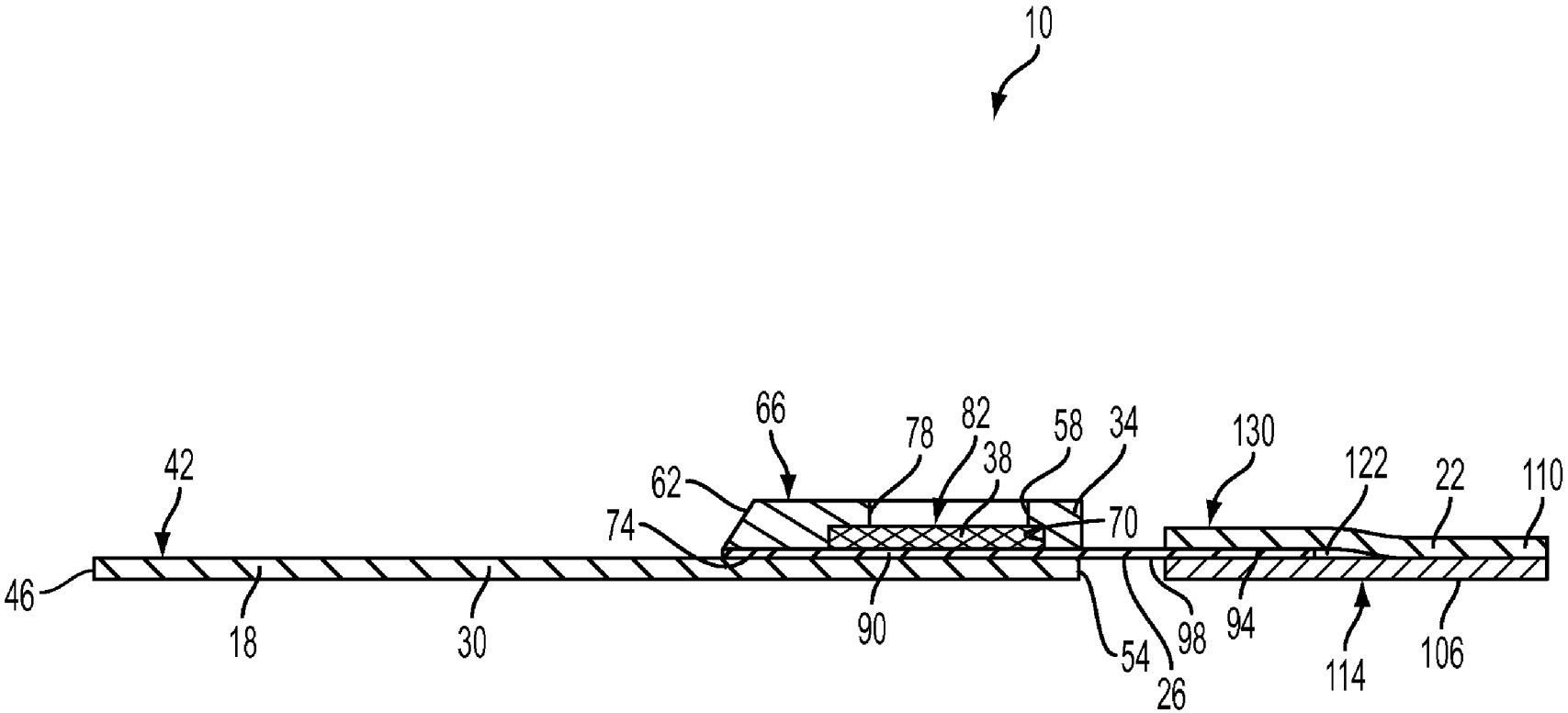
FIG. 4 is a section view taken along lines 4-4 of FIG. 2.

As shown in FIGS. 1, 2, and 4, the first portion 18 includes a base plate 30, a cover plate 34 coupled to the base plate 30, and a coupling member or magnet 38. During use, the first portion 18 of the badge 10 is at least partially received within a pocket 14 of the user's clothing. The first portion 18 acts as a base from which the second portion 22 is positioned and supported. In some constructions, the first portion 18 may also include an arrangement of loops, pockets, or other features suitable for supporting pens, business cards, and the like within the users pocket.

Figure 5:
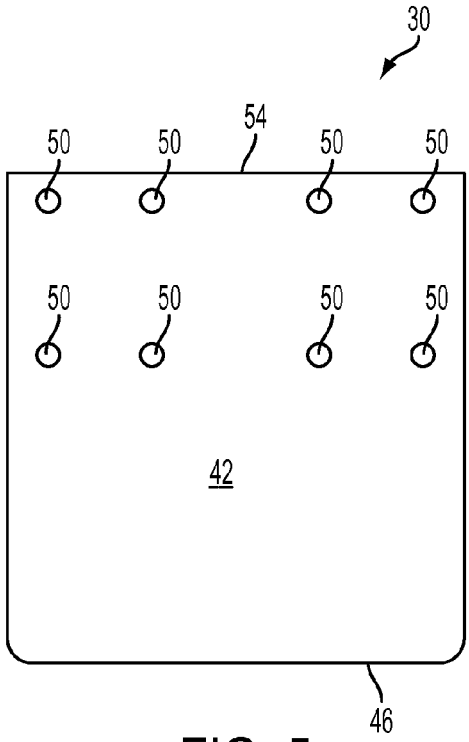
FIG. 5 is a front view of a base plate of the identification badge of FIG. 1.
Figure 6:
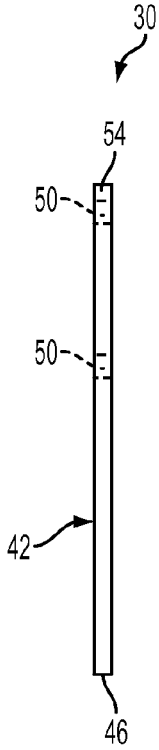
FIG. 6 is a side view of the base plate of FIG. 5.
Figure 7:
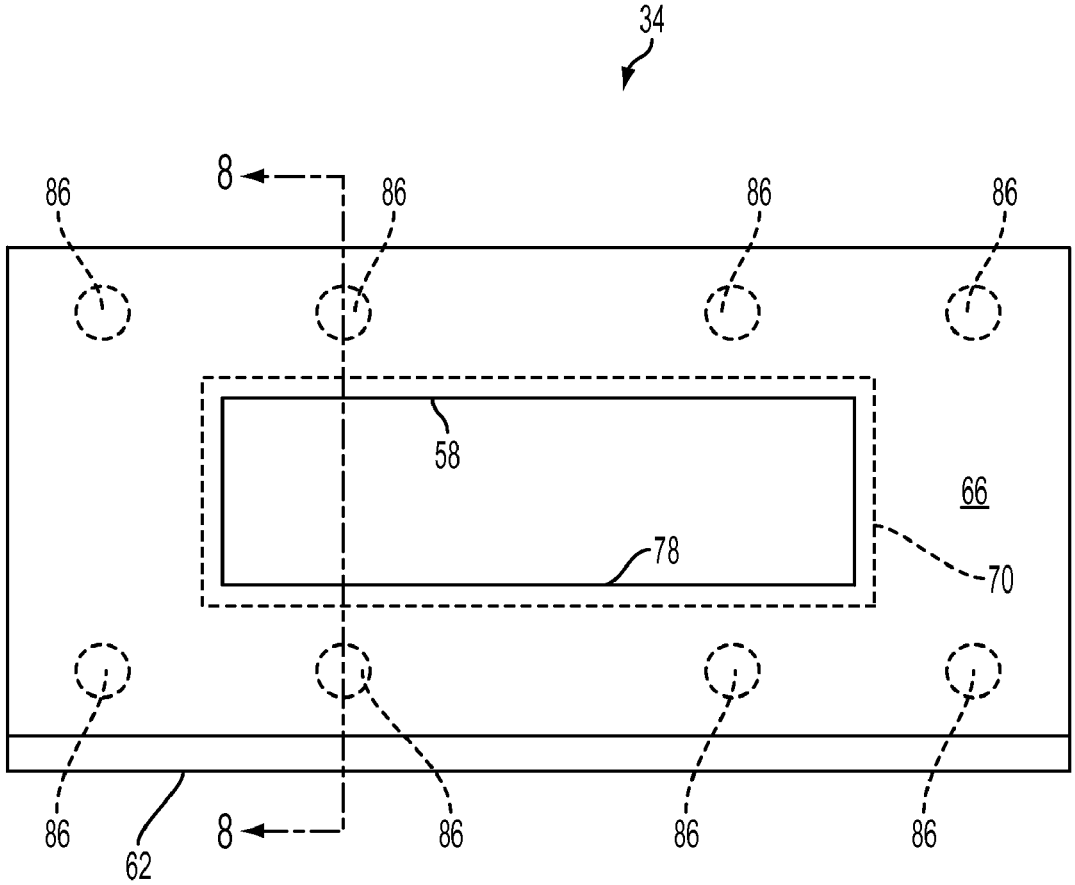
FIG. 7 is a front view of a cover plate of the identification badge of FIG. 1.
Figure 8:
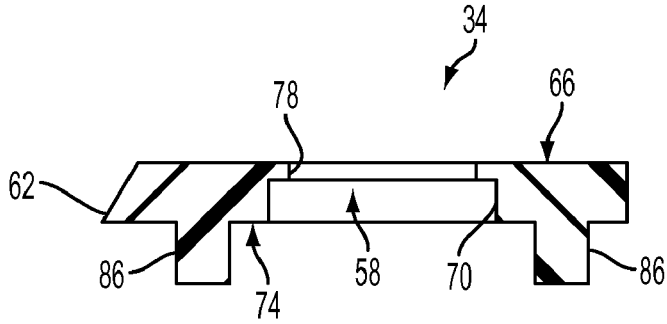
FIG. 8 is a section view taken along line 8-8 of FIG. 7.

With reference also to FIGS. 5 and 6, the base plate 30 generally is formed from a substantially planar section of sheet material such as plastic, metal, acrylic, or the like. The base plate 30 includes a front surface 42, a bottom edge 46, a top edge 54 opposite the bottom edge 46, and one or more (e.g., eight, as illustrated) apertures 50 positioned proximate the top edge 54. In the illustrated construction, the base plate 30 is substantially rectangular in shape, being sized to fit within a standard front pocket 14 of a polo shirt, button shirt, jacket, blazer and the like. In one exemplary construction, the base plate 30 is formed from a sheet of plastic material measuring 1/16" thick by 2¾" wide by 3" tall. In other constructions, the shape of the base plate 30 may vary dependent upon, among other things, the size and shape of the particular pocket into which it is intended to be inserted. In some constructions, the bottom edge 46 of the base plate 30 may be chamfered, tapered, or include radiused edges (see FIG. 5) to ease entry into the pocket 14. In still other constructions, the base plate 30 may include graphics, logos, text, and the like printed thereon.

Each aperture 50 is configured to receive and retain at least a portion of a corresponding alignment pin 86 (described below) extending from the cover plate 34. In the illustrated construction, each aperture 50 is tapered (see FIG. 9) to ease insertion of the alignment pins 86 during assembly. In alternate constructions the apertures 50 may include different shapes as necessary. In still other constructions, the apertures 50 may be threaded such that when the first portion 18 is assembled, a fastener may be introduced into the cover plate 34, extend through the hinge member 26, and be retained within the base plate 30.

With reference to FIGS. 1, 2, 4, 7 and 8, the cover plate 34 is substantially rectangular in shape and includes a top surface 66, a bottom surface 74, and a bottom edge 62. A generally rectangular recess 58 is recessed relative to the bottom surface 74 and is shaped to receive at least a portion of the magnet 38. An opening 78 extends through the top surface 66 and communicates with the recess 58 to expose the magnet when the magnet 38 is received within the recess 58.

Figure 9:
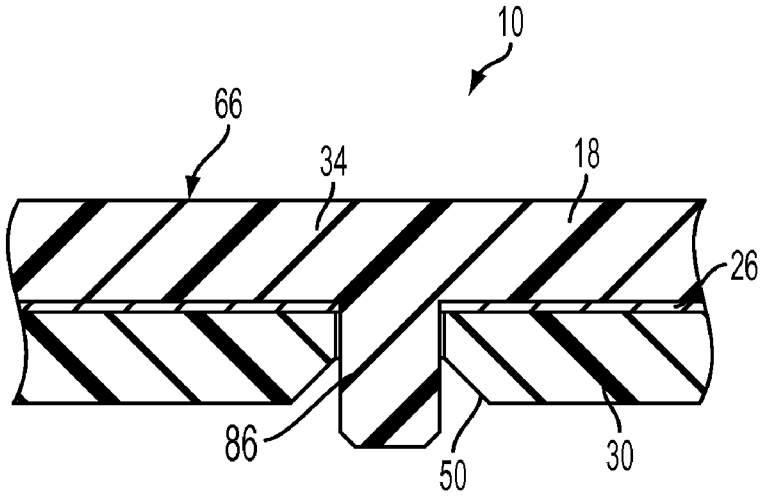
FIG. 9 is a section view taken along line 9-9 of FIG. 2.

The cover plate 34 also includes one or more (e.g., eight) alignment pins 86 extending from the bottom surface 74 and arranged for alignment with respective ones of the apertures 50 in the base plate 30. When the badge 10 is assembled, each pin 86 extends through a respective aperture 102 in the hinge member 26 and is received within a respective aperture 50 of the base plate 30, thereby aligning the three elements with respect to one another. As shown in FIG. 9, the pins 86 extend beyond the base plate 30 such that the pins 86 can be coupled to the base plate 30 by staking, melting, or other suitable processes.

In the illustrated construction, the bottom edge 62 of the cover plate 34 is chamfered (e.g., at 45 degrees, see FIG. 8) to minimize the possibility of entanglement with the fabric of the shirt when first portion 18 of the badge 10 is inserted therein. In some constructions, the top surface 66 of the cover plate 34 may be textured or coated with high friction material (not shown) to help further maintain the position of the badge 10 within the pocket 14.

The magnet 38 is substantially rectangular and positioned within the recess 58 of the cover plate 34. The magnet 38 is configured to maintain the second portion 22 of the badge 10 in the closed position (see FIG. 1). During use, the magnet 38 clamps a piece of fabric between the first and second portions 18, 22, thus holding the badge 10 in place. Although the coupling member in the illustrated embodiments is a magnet, in alternate constructions, the coupling member may include a spring steel hinge, spring loaded hinge, and the like, so long as the coupling member provides the clamping force between the first and second portions 18, 22. In the illustrated embodiment, the magnet 38 is an N35 block magnet with an N1 coating.

Figure 10:
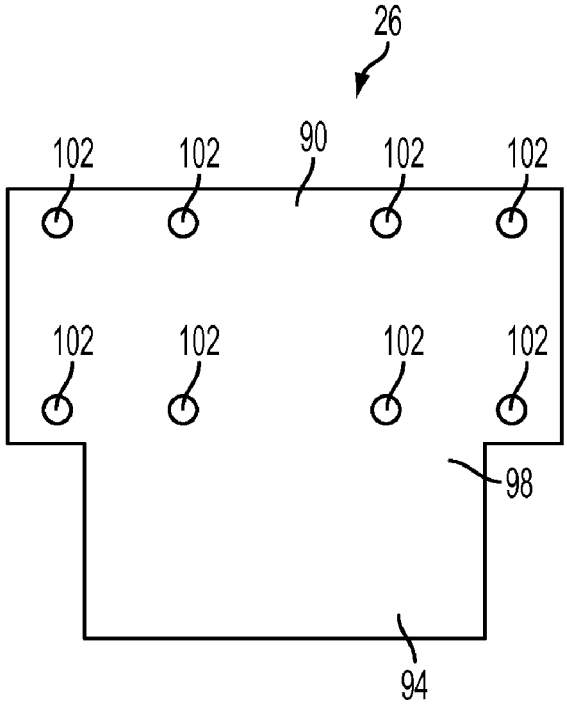
FIG. 10 is a front view of a hinge member of the identification badge of FIG. 1.

With reference to FIG. 10, the hinge member 26 is formed from a flexible material, such as 20 gauge (0.020" thick) clear PVC sheeting that allows the first and second portions 18, 22 to move (e.g., pivot) relative to one another between open and closed positions (see FIGS. 1 and 2, respectively).

The hinge member 26 includes a first end 90 couplable to the first portion 18 of the badge 10, a second end 94 couplable to the second portion 22 of the badge 10, and a flexible portion 98 extending between the first end 90 and the second end 94. The first end 90 of the hinge member 26 is substantially rectangular and defines one or more (e.g., eight) apertures 102 that substantially correspond to and are configured for alignment with the apertures 50 of the base plate 30. During assembly of the badge 10, the apertures 102 of the first end 90 are positioned such that the alignment pins 86 of the cover plate 34 extend through the apertures 102 of the hinge member 26 and are received by the base member 30 to align all three entities. In the illustrated construction, the first end 90 of the hinge member 26 is held in place solely by the pins 86, however in alternate constructions adhesives may be utilized. In still further constructions, the hinge member 26 may be formed jointly with the other portions of the badge 10.

The second end 94 of the hinge member 26 is shaped to substantially correspond to and be at least partially received within a detent 122 (described below) defined by the second portion 22 of the badge 10. In the illustrated construction, the second end 94 is coupled to the second portion 22 by way of double-sided adhesive tape, however in alternate constructions, alignment pins, fasteners, and the like may be utilized.

As described above, although the illustrated construction utilizes a thin, flexible hinge member 26, in alternate constructions the hinge member may include a solid pinned hinge, or a series of flexible wires or ropes. In still other constructions, the hinge may be formed from spring steel, or be spring loaded to either assist, or in some circumstances replace, the magnet 38.

Although the illustrated construction of the first portion 18 includes alignment pins 86 extending from the bottom surface 74 of the cover plate 34 and being received by the base plate 30, in alternate constructions the pins 86 may extend from the base plate 30 and be received by apertures within the cover plate 34 (not shown). Some constructions may include a cover plate 34 and a base plate 30 configured for snap fit engagement with one another. In still other constructions, alternate forms of alignment may be used to position the base plate 30, the cover plate 34 and the hinge member 26 with respect to one another. In still other constructions, adhesives may be used in place of staking the pins.

As shown in FIGS. 1-4, the second portion 22 of the badge 10 is formed from a first and second panel 106, 110 of sheet material coupled to one another to form a front surface 114 onto which indicia 118 may be printed. When the badge 10 is being worn, the second portion 22 is positioned on the outside of the pocket 14 such that the front surface 114 is clearly visible. In some constructions, the second portion 22 of the badge 10 may be interchangeable.

The first panel 106 of the second portion 22 is formed from a substantially rectangular piece of sheet material that has been formed (e.g., stamped) to create the front surface 114. The front surface 114 is preferably coated, polished, or otherwise treated to an aesthetically pleasing state onto which graphics, text, patterns, or other indicia may be printed. In some constructions, the indicia 118 may be adhered to the front surface 114 by a sticker or cling (not shown), however in alternate constructions, the indicia 118 may be printed directly to the front surface 114 or may include vinyl decals and the like. In still other constructions, the indicia 118 may be replaceable such that a single badge 50 may be used over and over for multiple people. As described above, the graphics typically include the user's name, title, company name, or other information that can help identify the wearer of the badge 10. Although shown blank, the front surface 114 may also include pre-printed coatings, background designs, patterns, textures, and the like to form a more customized look. In alternative constructions, the first panel 106 may form a unique shape such as a letter, animal, logo and the like.

The second panel 110 of the second portion 22 is formed from a sheet of ferro-magnetic sheet material and includes a contour substantially corresponding to the contour of the first panel 106. The second panel 110 is formed (e.g., stamped) to create a detent 122 therein. The detent 122 is sized and shaped such that when the first and second panels 106, 110 are coupled together, the detent 122 forms a volume therebetween sized to at least partially receive a portion of the hinge member 26 therein. In some constructions, the bottom surface 130 or detent 122 may be textured or coated with high friction material to help maintain the position of the badge 10 with respect to the pocket 14 or to help secure the second end 94 within the detent 122.

To assemble the badge 10, the magnet 38 is positioned within the recess 58 of the cover plate 34. The apertures 102 of the hinge member 26 are then aligned with the alignment pins 86 of the cover plate 34, with the flexible portion 98 extending opposite from the bottom edge 62. The hinge member 26 is positioned on the cover plate 34 by placing the apertures 102 over their respective pins 86. The apertures 50 of the base plate 30 can then also be aligned with the pins 86 with the bottom edge 46 of the base plate 30 extending opposite the flexible portion 98. The base plate 30 is then positioned onto the cover plate 34 by inserting the pins 86 into the apertures 50. The pins 86 are then secured within the apertures 50 (e.g. by staking, melting, sonic welding, or substantially any other suitable method, thereby coupling the base plate 30, the hinge member 26. The magnet 38 and the hinge member 26 are thus sandwiched between the base plate 30 and the cover member 34, and the hinge member 26 is fixed relative to the base plate 30 and the cover member 34 by the pins 86. The second end 94 of the hinge member 26 is then positioned within the detent 122 of the second panel 110, and the first panel 106 is aligned with and joined to the second panel 110 (e.g., using suitable adhesive or one of the other coupling methods discussed above.

The badge 10 may be applied to a user's pocket 14 as follows. Rotate the second portion 22 of the badge 10 into the open position (see FIG. 2). Introduce the bottom edge 46 of the first portion 18 into the desired pocket 14. Rotate the second portion 22 into the closed position (see FIG. 1) such that the flexible portion 98 of the hinge 26 extends over the top edge 134 of the pocket 14 and at least a bit of the pocket fabric is positioned between the first and second portions 18, 22, making sure that the indicia 118 is easily visible.

To remove the badge 10 from the pocket 14, rotate the second portion 22 of the badge 10 from the closed to open positions thereby freeing the fabric positioned between the first and second portions 18, 22. Remove the first portion 18 from the pocket 14 and store the badge 10 as necessary.

The invention claimed is:

1. A badge for placement within a pocket, the badge comprising:

a first portion shaped to be received within the pocket, the first portion including a base plate, a cover plate coupled to the base plate, and a magnet coupled to the base plate and at least partially surrounded by the cover plate, the cover plate including an aperture exposing at least a portion of the magnet, at least one of the base plate and the cover plate including at least one alignment pin and the other of the base plate and the cover plate including at least one alignment opening, the at least one alignment pin received by and secured within the at least one alignment opening;

a flexible member coupled to the first portion, the flexible member including a first end defining an aperture through which the at least one alignment pin extends, the flexible member including a second end extending away from the first portion; and a ferro-magnetic second portion coupled to the second end of the flexible member and movable relative to the first portion, the second portion including a first plate with indicia thereon and a second plate coupled to the first plate to form a detent therebetween, the second end of the flexible member positioned and secured within the detent, the second portion moveable between an open position spaced away from the coupling member and a closed position proximate the coupling member, wherein attraction between the ferro-magnetic second portion and the magnet secures the second portion in the closed position.

* * * * *